United States Patent [19]

Wafer et al.

[11] 4,255,732

[45] Mar. 10, 1981

[54] CURRENT LIMITING CIRCUIT BREAKER

[75] Inventors: John A. Wafer, Beaver; Walter V. Bratkowski, McKeesport, both of Pa.; Walter W. Lang, Rolla, Mo.

[73] Assignee: Westinghouse Electric Corp., Pittsburgh, Pa.

[21] Appl. No.: 951,941

[22] Filed: Oct. 16, 1978

[51] Int. Cl.[3] ..... H01H 75/00; H01H 77/00

[52] U.S. Cl. ..... 335/16; 335/193

[58] Field of Search ..... 335/16, 17, 46, 193, 335/195, 172, 173, 174

[56] References Cited

U.S. PATENT DOCUMENTS

| | | | |
|---|---|---|---|
| 3,127,488 | 3/1964 | Bodenschatz | 335/16 |
| 3,343,108 | 9/1967 | Murai | 335/16 |
| 3,460,075 | 8/1969 | Yorgin et al. | 335/173 X |
| 3,469,216 | 9/1969 | Shiraishi | 335/195 |
| 3,562,680 | 2/1971 | Ozaki et al. | 335/16 |
| 3,815,059 | 6/1974 | Spoelman | 335/16 |
| 3,944,953 | 3/1976 | Oster | 335/174 X |
| 4,056,798 | 11/1977 | Malick | 335/16 |
| 4,077,025 | 2/1978 | Slade et al. | 355/16 |
| 4,144,513 | 3/1979 | Shaffer et al. | 335/46 |

FOREIGN PATENT DOCUMENTS

| | | |
|---|---|---|
| 1193222 | 5/1970 | United Kingdom . |
| 1214363 | 12/1970 | United Kingdom . |

*Primary Examiner*—Fred L. Braun

*Attorney, Agent, or Firm*—Robert E. Converse, Jr.

[57] ABSTRACT

A molded case current limiting circuit interrupter includes a pair of pivoting contact arms each supporting a contact and being connected to wiring terminals such that current flows through the contact arms in opposite directions. One of the contact arms has a movable pivot point. A magnetic drive slot motor device is provided to generate electrodynamic contact opening force upon the contact arms during short circuit conditions. A high-speed magnetic trip device releases the operating mechanism under short circuit conditions to move the arm pivot point before the contact arms reclose. A spring latch may be provided to latch the upper contact arm in a contact-separated position during short circuit conditions until such time as the overcurrent flow through the breaker operates a thermal and magnetic trip mechanism to move an operating mechanism to the tripped position. Alternatively, a cam may be provided which is connected by a link to the upper contact arm and positioned such that upon short circuit conditions the contact opening motion of the upper contact arm caused by electrodynamic repulsion forces will cause the connecting link to rotate the cam and move the armature of the magnetic trip device to actuate the trip mechanism and release the operating mechanism to the tripped position, thereby preventing reclosing of the contact arms before the operating mechanism is able to trip. The operating mechanism includes a bracket to allow normal contact reset yet provide a positive closed contact indication if the contacts are welded together. An anti-rebound contact arm shock absorber is provided which is made of material having a high mechanical hysteresis loop to provide maximum energy dissipation.

19 Claims, 7 Drawing Figures

CURRENT LIMITING CIRCUIT BREAKER

CROSS-REFERENCE TO RELATED APPLICATIONS

The present invention is related to material disclosed in the following copending U.S. Patent Application, assigned to the assignee of the present invention:

Ser. No. 952,035, "Current Limiting Circuit Breaker with High Speed Magnetic Trip Device", filed Oct. 16, 1978, by W. E. Beatty and J. A. Wafer; and Ser. No. 952,036, "Current Limiting Circuit Breaker with Integral Magnetic Drive Device Housing and Contact Arm Stop", filed Oct. 16, 1978, by J. A. Wafer, R. H. Hill, and W. Stephenson.

BACKGROUND OF THE INVENTION

1. Field of the Invention

The invention relates generally to circuit interrupters and, more particularly, to circuit interrupters operating under short circuit conditions to limit the flow of current through the interrupter to a value lower than the available fault current which the circuit is capable of supplying.

2. Description of the Prior Art:

Circuit breakers are widely used in industrial, residential, and commercial installations to provide protection against damage due to overcurrent conditions. As the usage of electrical energy has increased, the capacity of sources supplying this electrical energy has increased correspondingly. Therefore, extremely large currents can flow through distribution circuits should a short circuit condition occur. Under these conditions conventional circuit interrupters are incapable of preventing severe damage to apparatus connected downstream from the interrupter.

Current limiting circuit interrupters were developed to provide the degree of protection necessary on circuits connected to power sources capable of supplying very large fault currents. One type of circuit interrupter provides such current limiting action by operating to achieve extremely rapid separation of the contacts during short circuit conditions. This action produces an arc voltage across the contacts which quickly approaches the system voltage, thus limiting the current flow between the contacts. Although the performance of prior art current limiting circuit interrupters of this type was adequate in certain applications, it would be desirable to provide a circuit breaker providing an even higher degree of current limiting action. Furthermore, prior art current limiting circuit interrupters were expensive to manufacture and bulky in size, thus limiting their applicability. It would therefore be desirable to provide a current limiting circuit interrupter offering increased performance in a smaller size at a more economical cost.

SUMMARY OF THE INVENTION

In accordance with a preferred embodiment of the present invention, there is provided a current limiting circuit interrupter comprising a housing, separable contacts disposed in the housing, and a high-speed operating mechanism having a carriage and means including a handle adapted for manual operation to move the carriage between open and closed positions. First and second pivoting contact arms are provided, each supporting one of the contacts. The first contact arm is pivotally attached to the carriage. Bias means are connected to the first contact arm to urge the first contact arm into a first position with respect to the carriage so that under normal conditions the attached contact arm and carriage rotate as a unit to open and close the separable contacts. During current limiting operations, the first contact arm pivots independently with respect to the carriage against the action of the bias means to a second position.

Means are provided for generating electrodynamic force upon the contact arms, such that under short circuit conditions through the circuit breaker, the contact arms are rapidly pivoted in opposite directions to separate the contacts thus stretching the arc to provide a high arc voltage and current limiting action.

The circuit breaker includes a high speed releasable operating mechanism for moving the carriage from the closed to the open position. High speed trip means responsive to current flow through the contacts are provided, an overcurrent condition through the contacts causing the trip means to release the operating mechanism and move the carriage to a tripped position to separate the contacts.

An extreme overcurrent condition through the circuit breaker generates electrodynamic force upon the contact arms sufficient to rapidly pivot them in opposite directions to separate the contacts, thus stretching the arc to provide a high arc voltage and current limiting action. The trip means then rapidly releases the operating mechanism to move the carriage to the tripped position before the first contact arm, under influence of the bias means, can return to the first position, thereby preventing reignition of the arc.

An anti-rebound spring latch may be provided for certain ratings to maintain the contact arm in the second position until the operating mechanism arrives at the tripped position. Alternatively, a cam-link arrangement may be provided so that movement of the contact arm to the second position initiates a tripping operation.

DESCRIPTION OF THE PREFERRED EMBODIMENT

Figure 1:
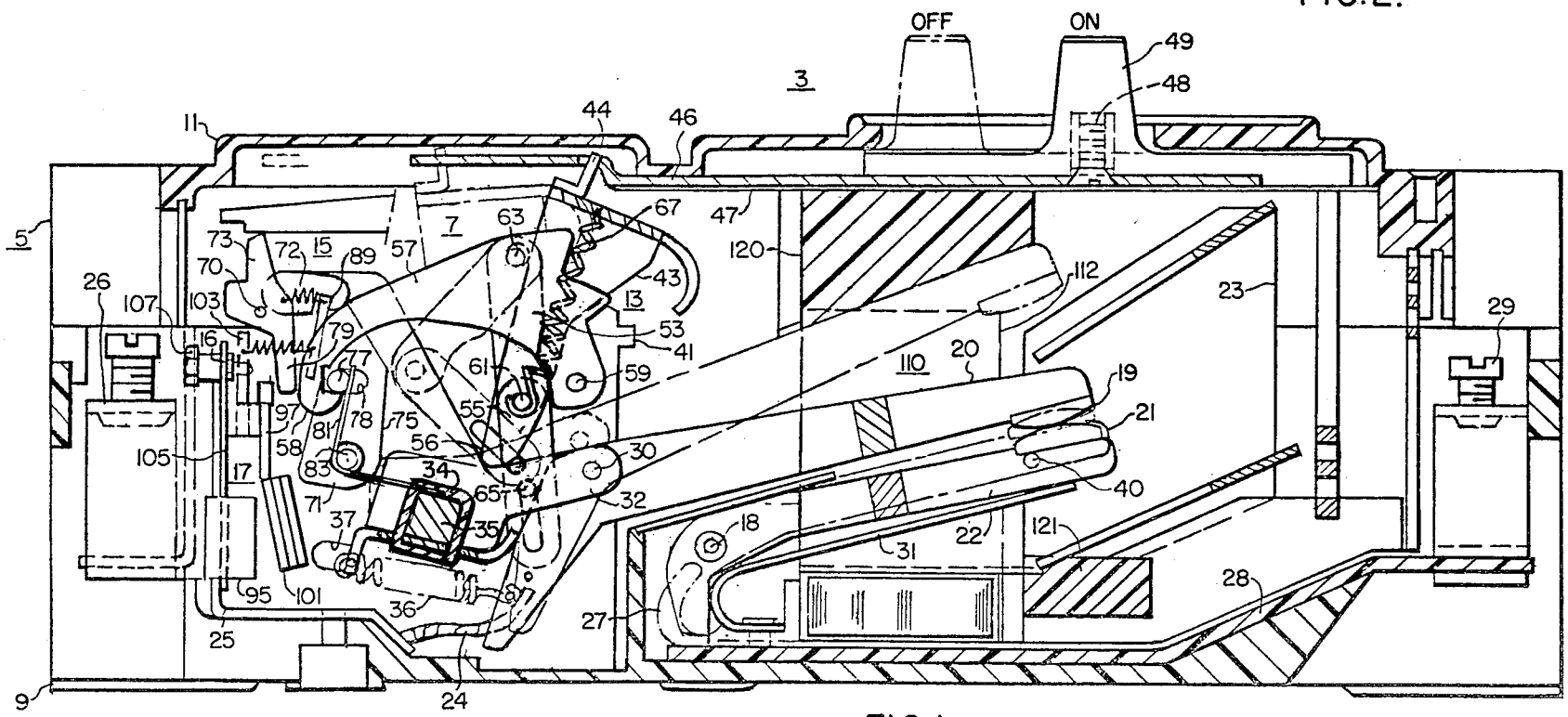
FIG. 1 is a side sectional view of a multi-pole current limiting circuit interrupter constructed according to the principles of the present invention, the contacts being shown in the closed position, (open position in dashed lines)

Referring now to the drawings, in which like reference characters refer to corresponding members, FIG. 1 shows a three pole circuit breaker 3 comprising an insulating housing 5 and a high-speed circuit breaker mechanism 7 supported in the housing 5. The housing 5 comprises an insulating base 9 having a generally planar back, and an insulating front cover 11 secured to the base 9. The housing 5 comprises insulating barriers separating the housing into three adjacent side-by-side pole unit compartments in a manner well known in the art.

The circuit breaker mechanism 7 comprises a single operating mechanism 13 and a single latch mechanism 15 mounted on the center pole unit. The circuit breaker mechanism 7 also comprises, in each of the three pole units, a separate thermal trip device 16 and a high-speed electromagnetic trip device 17. The high-speed electromagnetic trip device is more completely described in the aforementioned copending U.S. patent application Ser. No. 952,035.

A pair of separable contacts 19 and 21 attached to upper and lower pivoting contact arms 20 and 22, respectively, are provided in each pole unit of the breaker. An arc extinguishing unit 23 is also provided in each pole unit. The upper contact 19 is electrically connected, through the upper contact arm 20 (constructed of conducting material), to a shunt 24 which is in turn connected through a conducting strip 25 and the thermal and magnetic trip devices 16 and 17 to a terminal connector 26. The lower contact 21 is connected through the lower contact arm 22, also constructed of conducting material, through a shunt 27 and conducting strip 28 to a similar terminal connector 29. With the circuit breaker 3 in the closed position as is shown in FIG. 1, an electrical circuit thus exists from the terminal 26 through the conducting strips 25, the shunt 24, the upper contact arm 20, the upper contact 19, the lower contact 21, the lower arm 22, the shunt 27, and the conducting strip 28 to the terminal connector 29.

The upper contact arm 20 is pivotally connected at the point 30 to a rotating carriage 32, which is fixedly secured to an insulating rotatable tie bar 35 by a staple 34. A tension spring 36 connected between the left end of the upper contact arm 20 and a bracket 37 attached to the carriage 32 serves to maintain the upper contact arm 20 in the position shown in FIG. 1, with respect to the carriage 32. The upper contact arm 20 and carriage 32 thus rotate as a unit with the crossbar 35 during normal current conditions through the circuit breaker 3.

The single operating mechanism 13 is positioned in the center pole unit of the three pole circuit breaker and is supported on a pair of spaced metallic rigid supporting plates 41 that are fixedly secured to the base 9 in the center pole unit of the breaker. An inverted U-shaped operating lever 43 is pivotally supported on the spaced plates 41 with the ends of the legs of the lever 43 positioned in U-shaped notches 56 of the plates 41.

The U-shaped operating lever 43 includes a member 44 extending through a hole in a slide plate 46. The slide plate 46 is slidingly attached to the cover 11 by a support plate 47, and includes a member 48 seated in a molded handle member 49.

The upper contact arm 20 for the center pole unit is operatively connected by means of a toggle comprising an upper toggle link 53 and a lower toggle link 55 to a releasable cradle member 57 that is pivotally supported on the plates 41 by means of a pin 59. The toggle links 53 and 55 are pivotally connected by means of a knee pivot pin 61. The lower toggle link 55 is pivotally connected to the carriage 32 of the center pole unit by means of a pin 65 and the upper toggle link 53 is pivotally connected to the releasable cradle member 57 by means of a pin 63. Overcenter operating springs 67 are connected under tension between the knee pivot pin 61 and the bight portion of the operating lever 43. The lower contact arm 22 is pivotally mounted at the point 18 to the base 9.

A leaf spring 31 urges the lower contact arm 22 in a counterclockwise direction about the pivot point 18, the counterclockwise travel of the lower contact arm 22 being limited by a pin 40. Since the clockwise force upon the upper arm 20 in the closed position is greater than the counterclockwise force on the lower arm 22, a degree of overtravel is provided from the first point of contact between the arms until the fully closed position. This allows for the effect of contact wear.

The contacts 19 and 21 are manually opened by movement of the handle 49 in a leftward direction as seen in FIG. 1 from the ON position to the OFF position. This movement causes the slide plate 46 to rotate the operating lever 43 in a counterclockwise direction. The rotating movement of the operating lever carries the line of action of the overcenter operating springs 67 to the left causing collapse, to the left, of the toggle linkage 53, 55 to thereby rotate the crossbar 35 in a counterclockwise direction to simultaneously move the upper contact arms 20 of the three pole units to the open position, opening the contacts of the three pole units. The operating mechanism 13 is then in the position shown in dashed lines in FIG. 1.

The contacts are manually closed by reverse movement of the handle 49 from the OFF to the ON position, which movement moves the line of action of the overcenter springs 67 to the right to move the toggle linkage 53, 55 to the position shown in FIG. 1. This movement rotates the crossbar 35 in a clockwise direction to move the upper contact arms 19 of the three pole units to the closed position.

The releasable cradle 57 is latched in the position shown in FIG. 1 by means of the latch mechanism 15. The latch mechanism 15 comprises a primary latch member 71 and an insulating trip bar 73 pivoted at the point 70. The primary latch member 71 comprises a generally U-shaped latch lever 75 and a roller member 77 movably supported for limited travel in a pair of slots 78 in opposite legs of the lever 75. A torsion spring 81 biases the roller member 77 to one end of the slots. The primary latch member 71 is pivotally supported on the supporting plates 41 by means of a pin 83. The free end of the cradle 57 moves within a slot in the bight portion of the lever 75.

The trip bar 73 is a molded insulating member pivotally supported in the support plates 41, and is provided with a secondary latch member 89 for engaging the bight portion of the latch lever 75 of the primary latch member 71 to latch the primary latch member 71 in the position seen in FIG. 1. The releasable cradle 57 is provided with a hook portion 58 serving as a primary latching surface for engaging the roller 77 to latch the cradle 57 in the position seen in FIG. 1.

The primary latch member 71 includes a bias spring 72 secured at the upper end thereof, the other end of the bias spring 72 being seated against the trip bar 73. The bias spring 72, in compression, urges the primary latch member 71 in a clockwise direction about its pivot point 83. Thus, as soon as the trip bar 73 is rotated in the counterclockwise direction raising the secondary latch 89 away from the top of the latch lever 75, the bias spring 72 will rotate the primary latch member 71 in a clockwise direction allowing the cradle 57 to be released from the roller 77. The action of the bias spring 72 is overcome during a resetting operation as will be described hereinafter.

There is a separate high-speed electromagnetic trip device 17 in each pole unit. Each of the electromagnetic trip devices 17 comprises a generally U-shaped pole piece 95, the legs of which extend around the conducting member 25. An armature structure 97 is pivotally supported in the housing 5 and includes a laminated magnetic clapper 101 and an actuating member 103.

A separate thermal trip device 16 is also included in each pole unit. The thermal device 16 includes a bimetal element 105 welded to the conducting strip 25. The upper end of the bimetal element 105 includes an adjusting screw 107 threaded therein.

When the circuit breaker is in the latched position as seen in FIG. 1, the springs 67 operate through the toggle link 53 and pivot 63 to bias the cradle 57 in a clockwise direction about the pivot point 59. Clockwise movement of the cradle member 57 is restrained by engagement of the latching surface of the hook portion 58 under the roller 77 of the primary latch member 71, with the cradle member 57 pulling the primary latch member 71 in a clockwise direction about the pivot 83. Clockwise movement of the primary latch member 71 about the pivot 83 is restrained by engagement of the primary latch member with the secondary latch part 89 on the trip bar 73. The force of the primary latch member 71 against the secondary latch 89 of the trip bar 73 operates through the axis of the pivot 70 of the trip bar 73 so that clockwise movement of the primary latch member 71 is restrained by the trip bar 73 without tending to move the trip bar 73 about its axis. Thus, the trip bar 73 is in a neutral or latching position latching the primary latch member 71 and cradle member 57 in the latched position as seen in FIG. 1.

The circuit breaker is shown in the closed and reset position in FIG. 1. Upon occurrence of a high overload current above a predetermined value in any of the pole units, the clapper 101 is attracted toward the associated pole piece 95 whereupon the armature structure 97 pivots in a clockwise direction closing the air gap between the pole piece 95 and clapper 101 and pivoting the armature actuating member 103 in a clockwise direction against the member 79 of the trip bar 73. This causes rotation of the trip bar 73 in a counterclockwise direction moving the secondary latch 89 of the trip bar 73 out of engagement with the latch lever 75. The upward force of the cradle member 57 upon the roller 77 now rotates the primary latch member 71 in a clockwise direction, releasing the hook portion 58 of the cradle member 57. The force of the operating springs 67 upon the knee pin 61 is transmitted through the upper toggle link 53 to cause the cradle member 57 to rotate in a clockwise direction about the point 59. Continued rotation of the cradle member moves the upper toggle pin 65 to the right of the line of action of the operating springs 67, causing collapse of the toggle linkage 53, 55 to rotate the carriage 32 and the attached crossbar 35 in a counterclockwise direction and move all three upper contact arms 20 in a counterclockwise direction to simultaneously open the contacts of the three pole units. During this movement, the handle 49 is moved to a TRIP position between the OFF and ON positions in a well-known manner to provide a visual indication that the circuit breaker has been tripped.

Figures 3, 7:
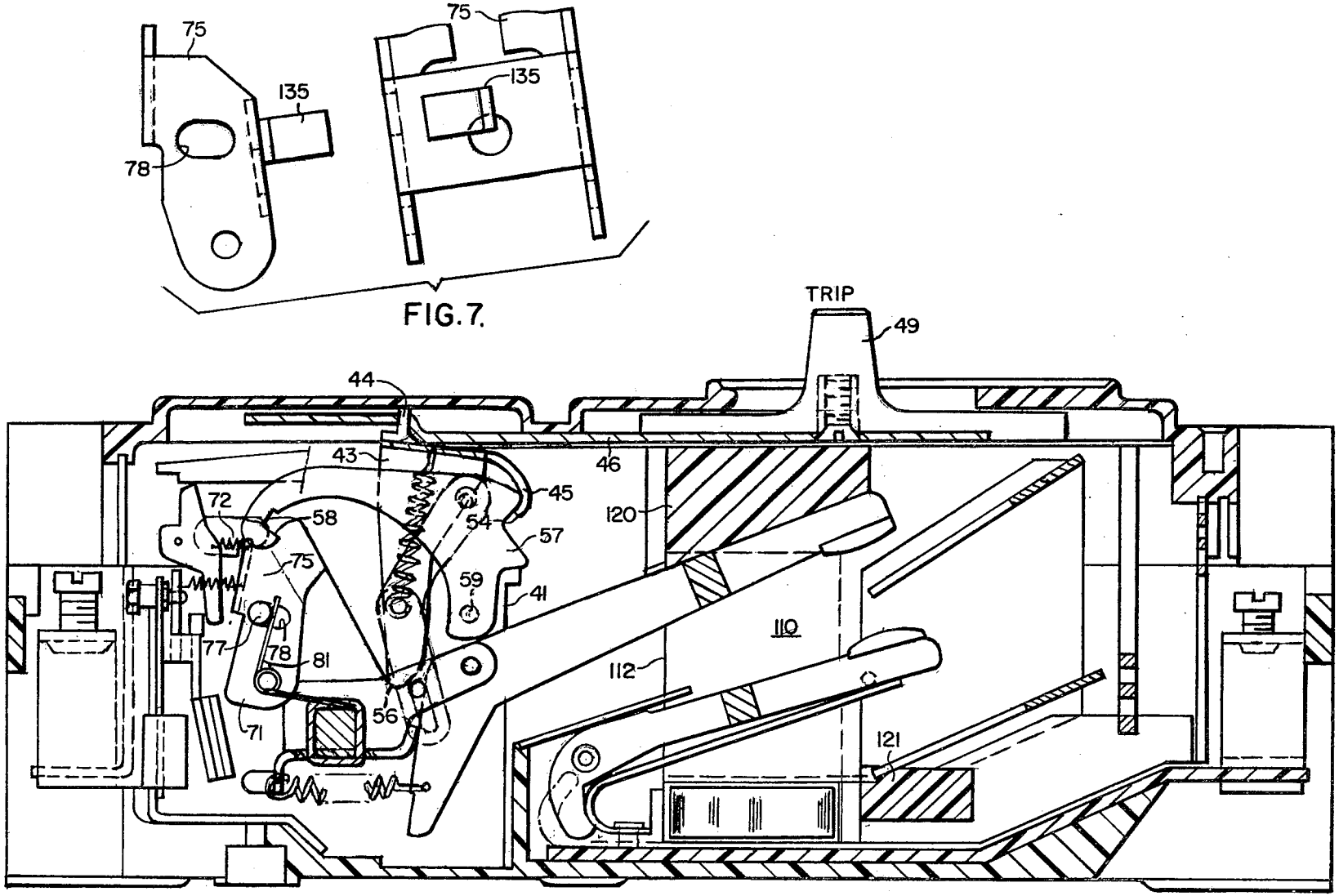
FIG. 3 is a view similar to FIG. 1, with the circuit interrupter shown in the tripped condition.
FIG. 7 is a detail view of a latch reset bracket shown in FIG. 6.

Before the circuit breaker can be manually operated after an automatic tripping operation as shown in FIG. 3, the circuit breaker mechanism must be reset and latched. This resetting operation is effected by movement of the handle 49 from the intermediate TRIP position to the left to the full OFF position. During this movement, the slide plate 46 acts upon the member 44 of the operating lever 43 to rotate the operating lever 43 in a counterclockwise direction about the pivot point at the notch 56 in the support plates 41. A lower extending member 45 of the operating lever 43 engages a corresponding surface 54 of the cradle member 57 to move the cradle member 57 from the position shown in FIG. 3 in a counterclockwise direction about the point 59.

During this movement, the hook portion 58 of the cradle member 57 moves down in the slot in the bight portion of the latch lever 75 of the primary latch member 71 and the hook portion 58 of the cradle member 57 comes in contact with the roller 77 to move the roller 77 to the right in the slots and wipe past the roller 77. When the hook portion 58 of the cradle member 57 passes the roller 77, the spring 81 snaps the roller 77 back to the position seen in FIG. 1. As the primary latch member 71 reaches the position seen in FIG. 1, a part of the member 71 clears the latch part 89 of the trip bar 73, whereupon the spring 72 biases the latch part 89 into latching engagement with the primary latch member 71 to latch the primary latch member 71 in the position seen in FIG. 1. Thereafter, upon release of the handle 49 by the operator, the springs 67 again act upon the toggle link 55 to bias the cradle member 57 in a clockwise direction to move the hook portion 58 up to engage the roller 77 in the latched position seen in FIG. 1. The handle 49 can then be manually moved back and forth between the ON and OFF positions to close and open the contacts.

With the circuit breaker in the closed and latched position as seen in FIG. 1, a low current overload condition will generate heat in the conductor member 25 and cause the upper end of the bimetal member 105 to flex to the right as seen in FIG. 1. The adjusting screw 107 impinges on the armature actuating member 103 of the armature structure 97. This causes counterclockwise rotation of the trip bar 73 to initiate a tripping action and achieve automatic separation of the contacts in all three pole units as hereinbefore described with regard to a magnetic trip.

Figure 2:
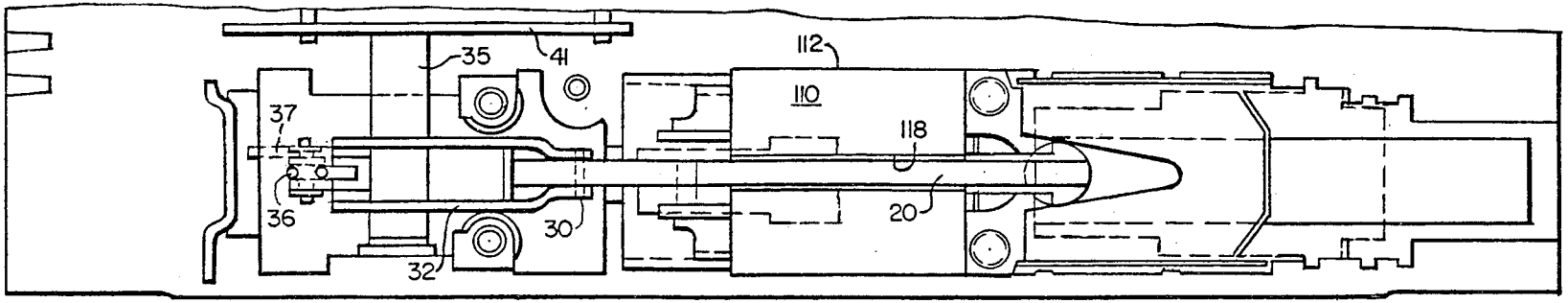
FIG. 2 is a top view of one outside pole of the circuit interrupter shown in FIG. 1.

As can be seen in FIGS. 1, 2 and 3, the circuit breaker also includes a slotted magnetic drive device 110. The magnetic drive device 110 includes a housing 112 having a slot 18 within which are disposed the upper and lower contact arms 20 and 22. The magnetic drive device 110 is described more completely in the aforementioned U.S. patent application Ser. No. 952,036.

A bumper member 120 is provided to limit the travel of the upper contact arm 20 during current limiting operations as will be described hereinafter. The bumper member 120 is composed of shock absorbing material such as polyurethane or butyl plastic. This type of material has a very large mechanical hysteresis loop, thus absorbing a maximum amount of energy and minimizing rebound. A similar member 121 mounted to the base 9 is provided for the lower arm 22.

Under short circuit conditions, extremely high levels of overload current flow through the circuit breaker 3. The current flow through the conductor member 28 and lower contact arm 22 generates a large amount of magnetic flux in the slotted magnetic drive device 110.

Figure 4:
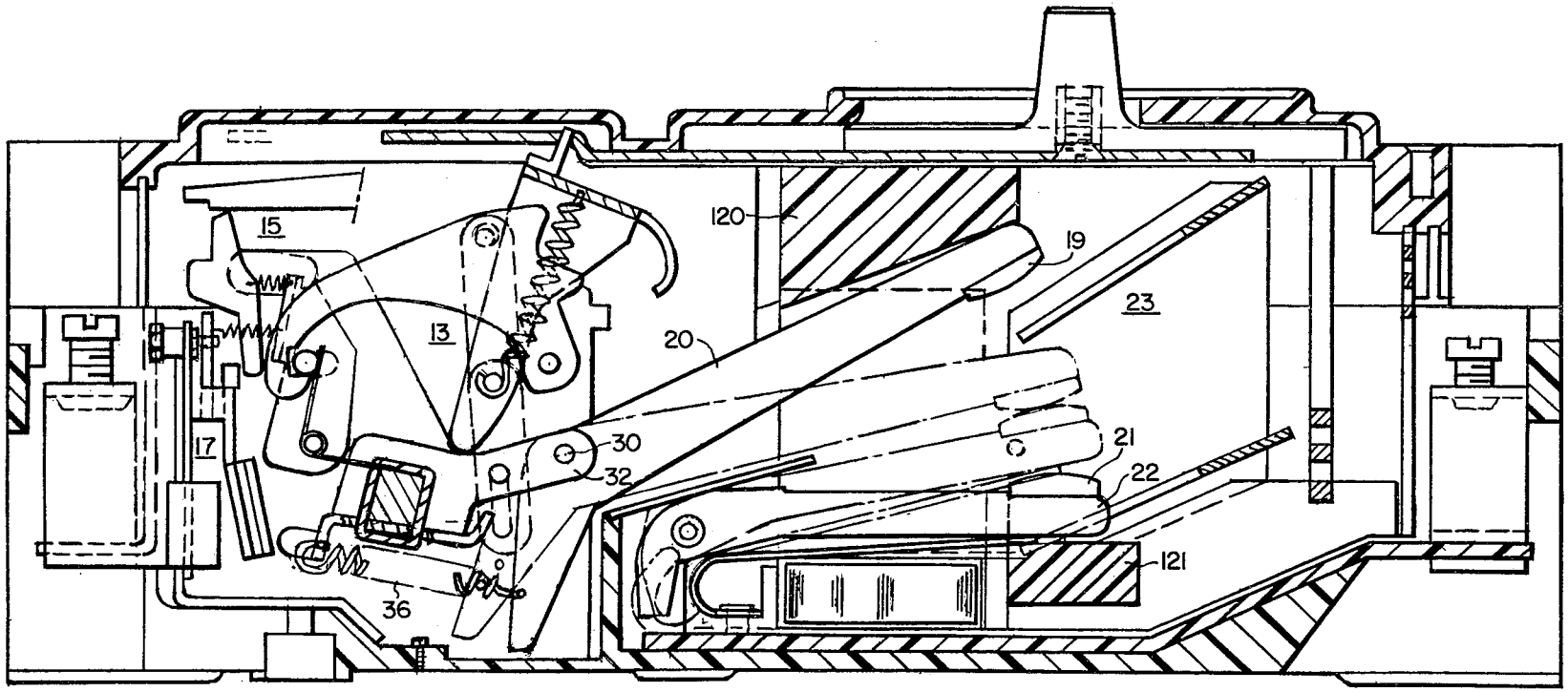
FIG. 4 is a view similar to FIGS. 1 and 3, with the circuit interrupter shown in the current limiting position.

This flux and the current flow through the lower contact arm 22 produces a high electrodynamic force upon the lower contact arm 22, tending to drive the arm 22 from the closed position shown in dashed lines in FIG. 4 toward the bottom of the slot 118. In addition, the current flow through the contact arms 20 and 22 in opposite directions generates a high electrodynamic repulsion force between the arms 20 and 22. This force builds up extremely rapidly upon occurrence of a short circuit condition, causing the upper contact arm 20 to pivot in a counterclockwise direction about the pin 30, acting against the tension force of the spring 36, from the closed position shown in dashed lines in FIG. 4 to the current limiting position shown in solid lines. The upper contact arm 20 is thus driven with great force into the bumper member 120, which is designed so as to minimize the amount of rebound of the upper contact arm 20. This rebound is undesirable since the established arc which has been extinguished by the arc extinguishing device 23 may restrike if the contacts 19 and 21 return to close proximity. The high-speed magnetic trip device 17 is therefore designed to operate the latch mechanism 15 to release the operating mechanism 13 before the arms 20 and 22 can reclose. As the operating mechanism 13 moves from the closed positon shown in FIG. 4, to the tripped position shown in FIG. 3, the carriage 32 rotates in a counterclockwise direction to raise the pivot point 30 of the upper contact arm 20 before the tension spring 36 returns the upper contact arm 20 to the first position with respect to the carriage 32 as shown in FIG. 1.

The initial high opening acceleration of the contact arms produces a high arc voltage resulting in extremely effective current limiting action. The combination of the high speed electromagnetic trip device and high speed operating mechanism assures that the contacts will remain separated to prevent re-establishment of the arc after it is extinguished.

Figure 5:
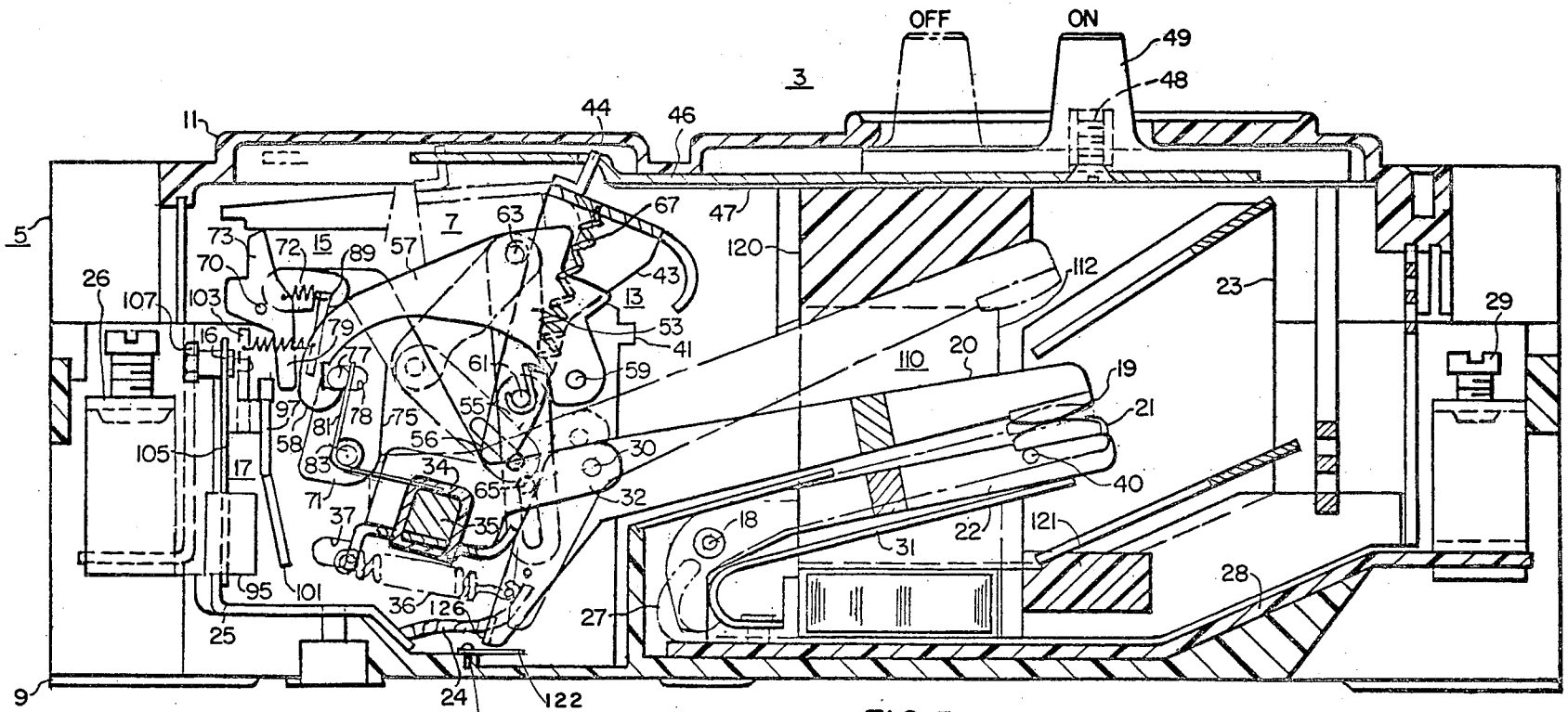
FIG. 5 is a side sectional view of an alternative embodiment of the present invention which is provided with a spring arm latch to maintain separation of the contact arms during current limiting operations.

An alternative embodiment suitable for higher rating circuit breakers is shown in FIG. 5. An arm latch , or restraining means, 122 is secured to the base 9 by a rivet 124. A latching surface 126 is provided on the end of the upper contact arm 20. Under short circuit conditions when the arm 20 is rotated counterclockwise about the pivot point 30, the latch 122 engages the surface 126 to lock the arm 20. This prevents return rotation of the arm in the clockwise direction about the point 30 as the electrodynamic repulsion forces reduce due to the approach toward current zero of the fault current waveform. The arm 20 remains in this position with respect to the carriage 32 until the trip mechanism 17 releases the latch and operating mechanism 13 to move the carriage 32 and pivot point 30, thus releasing the surface 126 from the latch 124.

Figure 6:
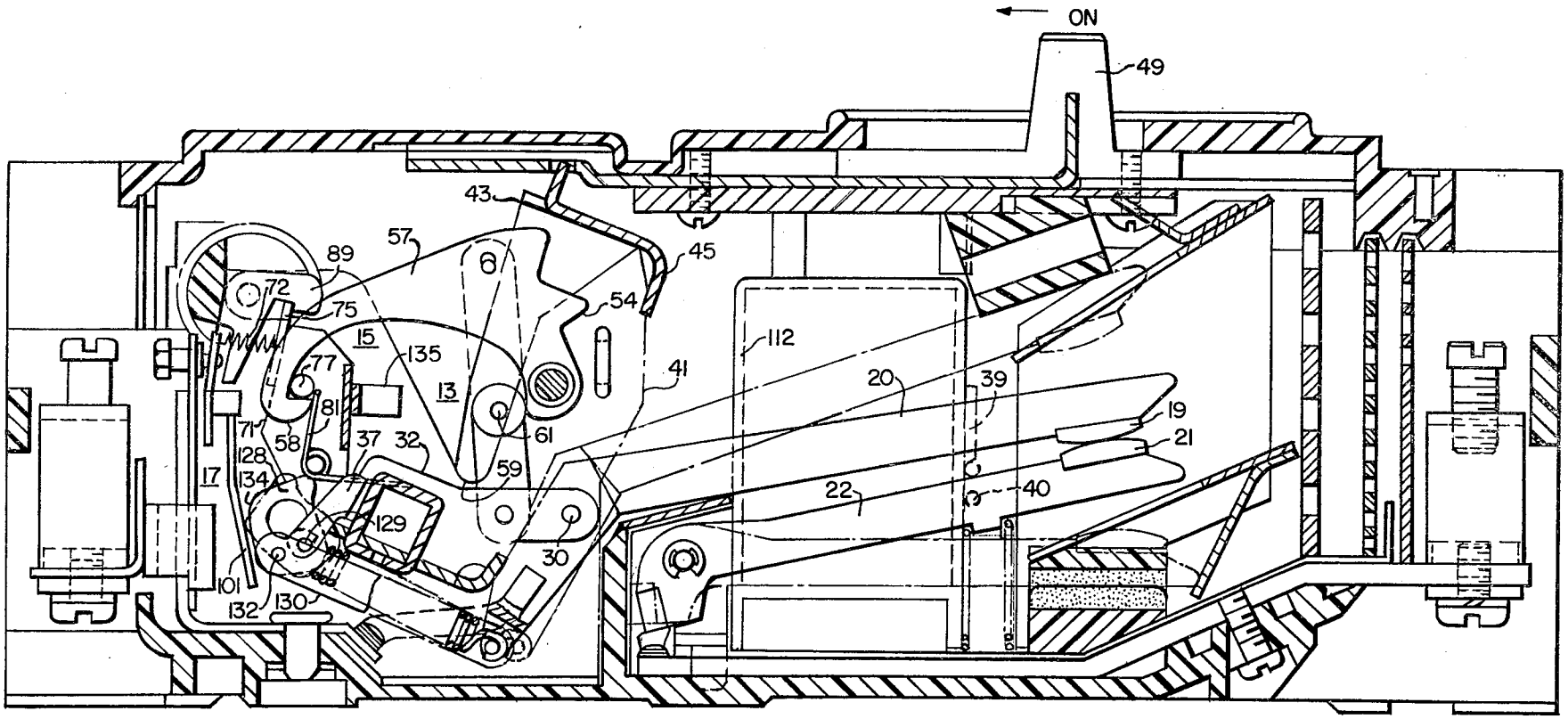
FIG. 6 is a side sectional view of a second alternative embodiment of the present invention having a cam link mechanism, with the circuit interrupter shown in the closed position.

Another alternative construction of the current limiting circuit 3 is shown in FIG. 6. This alternative is also suitable for higher rating circuit breakers. A cam member 128 including a cam surface 134 is pivotally connected at the point 129 to the bracket 37 of the carriage 32. A rigid link 130 is connected between a pin 132 on the cam 128 and the left-hand end of the upper contact arm 20.

Upon short circuit conditions with the circuit breaker 3 in the closed position as shown in FIG. 6, the upper contact arm 20 will rapidly rotate in a counterclockwise direction about the point 30 with respect to the carriage 32. The link member 130 will thus move to the right, causing counterclockwise rotation of the cam member 128 about the pin 129. The cam surface 134 of the cam member 128 will strike the clapper 101 of the magnetic trip device 17, causing release of the latch mechanism 15 in the manner hereinbefore described with regard to a magnetic tripping operation. The latch mechanism is thus released causing collapse of the operating mechanism 13 in a shorter interval following counterclockwise pivoting of the upper contact arm 20 than is the case for a current limiting circuit breaker not including the cam member 128 and link 130.

The cam 128 and link 130 are provided in current limiting circuit breakers designed for applications having high available fault currents. During short circuit conditions in such a circuit breaker, the contact arms 20 and 22 are separated extremely rapidly. For some ratings of breakers, the magnetic force upon the clapper 101 is not sufficient to overcome the inertia thereof, preventing sufficiently rapid initiation of a tripping operation. Using the cam-link arrangement as shown in FIG. 6 provides a circuit breaker which will initiate a tripping operation concurrent with separation of the contact arms 20 and 22. Accordingly, the operating mechanism 13 is released in a sufficiently short time to prevent contact restrike.

As can be seen in FIGS. 6 and 7, the latch lever 75 may include an L-shaped reset bracket 135 welded thereto. Following a tripping operation, the operating mechanism 13 is reset by sliding the handle 19 from the TRIP position, midway between the ON and OFF positions, to the OFF position. This rotates the operating lever 43 in a counterclockwise direction about the pivot point in the notch 56 of the support plates 41. The knee pin 61 of the toggle linkage contacts the reset bracket 135, rotating the primary latch member 71 in a counterclockwise direction against the action of the bias spring 72 until the end of the latch lever 75 is below the secondary latch 89. Concurrent with this operation, the cradle 57 is also being rotated in a counterclockwise position (by the action of the member 45 against the surface 54), with the hook portion 58 wiping past the roller 77, to move the roller 77 to the right in its slots against the action of the spring 81 until the hook portion 58 is below the roller 77. Roller 77 then snaps into the position shown in FIG. 6 to secure the cradle 57 in the latched position. The contacts 19 and 21 may then be moved to the closed position by sliding the handle from the OFF to the ON position.

In the event that the contacts 19 and 21 become welded together due to extreme overcurrent conditions, the latch mechanism 15 will be released by the magnetic trip device 17. The contact arms 20 and 22 will rotate in a counterclockwise direction until the pin 40 reaches the stop 39 (FIG. 6) on the slot motor housing 112. If an attempt is then made to reset the circuit breaker, the handle 49 will be moved to the left toward the OFF position. This will rotate the operating lever 43 and the cradle 57 in a counterclockwise direction. The hook portion 58 will be moved below the level of the roller 77. However, because the upper contact arm 20 (which is connected to the toggle linkage through the carriage 32) is welded to the lower contact arm, it is not possible to move the knee pin 61 far enough to the left to contact the reset bracket 135. Thus, the bias spring 72 maintains the primary latch member 71 in a state of clockwise rotation such that the roller 77 remains to the right of the hook portion 58. The cradle 57 will not be secured in the latched position. When pressure is released from the handle 49, the force of the operating springs 67 will move the handle back to the ON position, thus indicating the true state of the contacts 19 and 21. This "positive-on" feature is very important, since it is desirable that an operator have knowledge that the contacts are indeed welded in the closed position despite the attempt to open or reset the circuit breaker.

A circuit breaker having a pair of pivoting contact arms, one of which has a movable pivot point, and a high speed magnetic trip device as described herein provides extremely rapid contact separation and current limiting action. In addition, the features including the slotted magnetic drive device, the spring latch member, the cam link arrangement, the reset bracket, and shock absorber aid in providing a current limiting circuit breaker which is not subject to restrike or reclosure and includes a positive indication of a contact closure state. In summary, it can be seen that the present invention provides a current limiting circuit breaker exhibiting superior performance over the prior art.

We claim:

1. A current limiting circuit interrupter, comprising:

a housing;

separable contacts disposed in said housing;

an operating mechanism comprising a pivoting carriage and means adapted for manual operation to pivot said carriage between open and closed positions;

contact support means comprising first and second pivoting contact arms each supporting one of said contacts, said first contact arm being pivotally attached to said carriage, and means for restricting relative motion between said carriage and said first contact arm to rotation;

bias means connected to said first contact arm, said bias means urging said first contact arm into a first position with respect to said carriage so that said attached contact arm and said carriage rotate as a unit to open and close said separable contacts; and means connected to said contact arms for causing circuit current to flow through said contacts and through said contact arms in opposite directions when said carriage is in the closed position and for generating electrodynamic force urging said contacts apart to cause said contact arms to rapidly pivot in opposite directions to separate said contacts and provide current limiting action, said first contact arm pivoting independently with respect to said carriage against the action of said bias means to a second position.

2. A current limiting circuit interrupter as recited in claim 1 wherein said first contact arm is pivotally attached to said carriage at a point intermediate its two ends, said contact being supported at one end of said first contact arm and said bias means being attached at the opposite end thereof.

3. A current limiting circuit interrupter as recited in claim 2 comprising second bias means attached to said second contact arm and urging said second contact arm into a closed position.

4. A current limiting circuit interrupter as recited in claim 3 comprising a slotted magnetic drive device having an open end and a closed end, said second contact arm being disposed in said slot in proximity to said open end when said second contact arm is in the closed position, a short circuit condition through said circuit interrupter generating magnetic flux in said magnetic drive device to produce electrodynamic force upon said second contact arm to drive said second contact arm toward said slot closed end.

5. A current limiting circuit interrupter as recited in claim 2 wherein said operating mechanism comprises latch means for maintaining said operating mechanism in a latched position to allow manual operation of said circuit interrupter between open and closed positions, said latch means releasable to place said operating mechanism in a tripped position thereby opening said contacts and preventing operation of said circuit interrupter to a closed position;

said circuit interrupter comprising trip actuator means responsive to overcurrent conditions through said circuit interrupter to release said latch means and place said operating mechanism in the tripped position, said circuit interrupter also comprising arm restraining means to latch said first contact arm in said second position.

6. A current limiting circuit interrupter as recited in claim 5 wherein movement of said operating mechanism to the tripped position is operable to release said arm restraining means to allow said first contact arm to return to said first position.

7. A current limiting circuit interrupter as recited in claim 6 wherein said arm restraining means cooperates with the end of said first contact arm opposite its contact to latch said first contact arm.

8. A current limiting circuit interrupter as recited in claim 1 wherein said operating meachanism comprises latch means for maintaining said operating mechanism in a latched position to allow manual operation of said circuit interrupter between open and closed positions, said latch means releasable to place said operating mechanism in a tripped position thereby opening said contacts and preventing operation of said circuit interrupter to a closed position;

said circuit interrupter comprising trip actuator means responsive to overcurrent conditions through said circuit interrupter to release said latch means and place said operating mechanism in the tripped position, said circuit interrupter also comprising arm restraining means to latch said first contact arm in said second position.

9. A current limiting circuit interrupter as recited in claim 8 wherein movement of said operating mechanism to the tripped position is operable to release said arm restraining means to allow said first contact arm to return to said first position.

10. A current limiting circuit breaker comprising:

a housing;

separable contacts disposed in said housing;

first and second pivoting contact arms each supporting one of said contacts, said first contact arm comprising a movable pivot point;

means biasing said contact arms toward each other;

means limiting the travel of said arms in a direction toward each other;

a high-speed releasable operating mechanism for moving said movable pivot point from a closed to an open position to separate said contacts;

high-speed trip means responsive to current flow through said contacts for releasing said operating mechanism to a tripped position, thereby moving said pivot point upon overcurrent conditions through said contacts; and means for generating electrodynamic contact separating force upon said contact arms upon extreme overcurrent conditions through said contacts, comprising conductive means connected to said contact arms so as to cause circuit current to flow through said contact arms in opposite directions, and a slotted magnetic drive device disposed about said contact arms, said device having an open end and a closed end defining a slot, said force generating means repelling said contact arms to rapidly separate said contacts upon extreme overcurrent conditions, thereby interrupting an arc established between said contacts and limiting the peak current flow through said contacts;

said trip means rapidly releasing said operating mechanism to move said pivot point to said open position before said bias means returns said contact arms into proximity with each other sufficient to reestablish and arc.

11. A current limiting circuit breaker, comprising;

a housing;

separable contacts disposed in said housing;

first and second pivoting contact arms each supporting one of said contacts, said first contact arm comprising a movable pivot point;

means biasing said contact arms toward each other;

means limiting the travel of said arms in a direction toward each other;

a high-speed releasable operating mechanism for moving said movable pivot point from a closed to an open position to separate said contacts;

high-speed trip means responsive to current flow through said contacts for releasing said operating mechanism to a tripped position, thereby moving said pivot point upon overcurrent conditions through said contacts; and means for generating electrodynamic force upon said contact arms upon extreme overcurrent conditions through said contacts to rapidly separate said contact arms, thereby interrupting an arc established between said contacts and limiting the peak current flow through said contacts;

said trip means rapidly releasing said operating mechanism to move said pivot point to said open position before said bias means returns said contact arms into proximity with each other sufficient to reestablish an arc;

a shock absorber positioned to limit the travel of said contact arms in the opening direction when rapidly separated due to extreme overcurrent conditions, said shock absorber comprising material having a high mechanical hysteresis loop so as to absorb a maximum amount of kinetic energy from said contact arms and minimize the rebound of said contact arms following impact with said shock absorber.

12. A current limiting circuit interrupter, comprising:

a housing;

separable contacts disposed in said housing;

a pair of pivoting contact arms each supporting one of said contacts and movable between open and closed positions;

an operating mechanism connected to said contact arms for operating said contact arms between open and closed positions in response to manual or automatic initiation;

conductive means connected to said contact arms adapted for connection to an external circuit being protected to cause current flow in opposite directions through said contact arms when said contact arms are in the closed position; so that a short circuit current through said circuit interrupter generates an electrodynamic contact-separating repulsion force between said contact arms to drive said contact arms in opposite directions to separate said contacts; and a slotted magnetic drive device disposed about one of said contact arms so that short circuit conditions through said circuit interrupter also generate magnetic flux in said magnetic drive device to produce an additional electrodynamic contact-separating force upon said contact arms to aid in the rapid separation thereof.

13. A current limiting circuit interrupter, comprising:

a housing;

separable contacts disposed in said housing;

an operating mechanism disposed in said housing comprising movable contact arm support means, said operating mechanism adapted for manual operation to move said contact arm support means between open and closed positions and for automatic operation to move said contact arm support means from the closed to the open position;

a movable contact arm movably attached to said contact arm support means, said movable contact arm supporting one of said contacts;

bias means connected to said movable contact arm for maintaining said movable contact arm in a first position with respect to said contact arm support means so that said movable contact arm and said contact arm support means move as a unit for all current levels through said circuit interrupter which are below a predetermined extreme overload current level;

tripping means responsive to current flow through said circuit interrupter and coupled to said operating mechanism for initiating automatic operation of said operating mechanism to move said contact arm support means to the open position upon occurrence of overload current condition including overload current levels below said predetermined extreme overload level;

conductive means disposed in relationship to said movable contact arm to generate electrodynamic opening forces upon said movable contact arm upon occurrence of overcurrent conditions above said predetermined extreme overload level, said forces overcoming the action of said bias means to cause said movable contact arm to move with respect to said movable contact arm support means to separate said contacts; and means connecting said movable contact arm and said tripping means such that movement of said movable contact arm with respect to said movable contact support means is operable to actuate said tripping means and initiate automatic operation of said operating mechanism to move said contact arm support means to the open position.

14. A current limiting circuit interrupter as recited in claim 13 comprising a pair of pivoting contact arms, each arm supporting one of said contacts.

15. A current limiting circuit interrupter as recited in claim 14 wherein said conductive means are connected to said pivoting contact arms such that current flows in opposite directions therethrough.

16. A current limiting circuit interrupter as recited in claim 13 wherein said connecting means comprises a link member having one end connected to said movable contact arm, and a cam member pivotally connected to said movable contact arm support means, the other end of said link member being connected to said cam member such that relative movement between said movable contact arm and said movable contact arm support means is operable to rotate said cam and cause actuation of said tripping means.

17. A current limiting circuit interrupter as recited in claim 16 wherein said tripping means comprises an electromagnet and an armature member positioned in proximity to said cam member, an overcurrent condition causing said electromagnet to attract and move said armature member to cause automatic operation of said operating mechanism and separation of said contacts;

an overcurrent condition above said extreme overcurrent level causing rotation of said cam member such that said armature member is operated on and moved by said cam member before said armature member is moved by said electromagnet.

18. A molded case current limiting circuit breaker comprising:

a housing;

separable contacts disposed in said housing;

a pair of pivoting contact arms each supporting one of said contacts and movable between open and closed positions;

an operating mechanism connected to one of said contact arms for opening and closing said contacts;

conductive means connected to said contact arms and adapted for connection to an external electrical circuit being protected, said conductive means connected so as to cause current flow in opposite directions through said contact arms when said contact arms are in the closed position so that extreme overcurrent conditions through said apparatus generate electrodynamic repulsion force between said contact arms to drive said contact arms in opposite directions and rapidly separate said contacts; and shock absorbing means positioned so as to limit the opening travel of said contact arms upon extreme overcurrent conditions, said shock absorbing means comprising material having a large mechanical hysteresis loop so as to absorb a maximum amount of kinetic energy from said contact arms and minimize the rebound of said contact arms following impact with said shock absorbing means.

19. A molded case current limiting circuit breaker, comprising:

a housing;

separable contacts disposed in said housing;

a pair of pivoting contact arms supporting said contacts;

an operating mechanism connected to said contact arms and comprising a handle adapted for manual operation between OPEN and CLOSE positions to actuate said mechanism to separate and engage said contacts;

trip means responsive to current flow through said contacts, said trip means being releasable upon overcurrent conditions through said contacts to automatically operate said mechanism to separate said contacts;

means cooperating with said mechanism and said handle so that manual operation of said handle to the open position following release of said trip means is operable to reset said trip means only if said contacts are separated, whereby stable positioning of said handle in a position indicating separation of said contacts is possible only if said contacts are actually separated.

* * * * *